US007922134B2

(12) United States Patent
Gasser

(10) Patent No.: US 7,922,134 B2
(45) Date of Patent: Apr. 12, 2011

(54) OBJECTS INCLUDING GAMING STOOLS WITH AN EASY ROLLING SUPPORT BASE

(75) Inventor: Mark E. Gasser, Hubbard, OH (US)

(73) Assignee: Gasser Chair Company, Inc., Youngstown, OH (US)

( * ) Notice: Subject to any disclaimer, the term of this patent is extended or adjusted under 35 U.S.C. 154(b) by 54 days.

(21) Appl. No.: 11/177,086

(22) Filed: Jul. 8, 2005

(65) Prior Publication Data

US 2006/0082202 A1 Apr. 20, 2006

Related U.S. Application Data

(60) Provisional application No. 60/620,061, filed on Oct. 19, 2004.

(51) Int. Cl.
*A47B 91/00* (2006.01)
*A47B 95/00* (2006.01)

(52) U.S. Cl. ..... 248/129; 248/98; 248/425; 248/349.1; 297/461; 297/344.16; 297/423.1; 16/31 A; 16/31 R; 16/35 R; 16/43; 280/35; 280/79.11; 280/79.2; 280/47.38; 280/47.34

(58) Field of Classification Search ..... 248/425, 248/129, 349.1, 98; 297/461, 344.16, 423.1; 16/31 A, 31 R, 35 R, 43; 280/35, 79.11, 280/79.2, 47.38, 47.34
See application file for complete search history.

(56) References Cited

U.S. PATENT DOCUMENTS 1,691,035 A * 11/1928 Adams ..... 108/141
1,953,764 A * 4/1934 Menton ..... 248/425
2,308,358 A * 1/1943 Cramer ..... 297/423.38
2,552,592 A * 5/1951 Rush ..... 297/195.11
2,659,413 A * 11/1953 Cramer ..... 297/423.38
3,179,369 A * 4/1965 Hale ..... 248/404
3,220,045 A * 11/1965 Teague et. al. ..... 16/43
3,614,155 A * 10/1971 Campbell et al. ..... 297/129
3,711,054 A * 1/1973 Bauer ..... 248/562
4,085,983 A * 4/1978 Johnson ..... 384/415
4,349,938 A * 9/1982 Fontana ..... 16/35 R
4,372,605 A * 2/1983 Cervantes ..... 297/188.11
4,429,918 A * 2/1984 Alsup et al. ..... 297/353
4,753,407 A * 6/1988 Brock ..... 248/346.01
4,779,925 A * 10/1988 Heinzel ..... 297/300.4
5,022,706 A * 6/1991 Bryan ..... 297/162
5,299,659 A * 4/1994 Imbeault et al. ..... 414/592
5,309,670 A * 5/1994 Bates ..... 47/71
5,346,415 A 9/1994 Waymon et al.
5,366,275 A * 11/1994 Sulzer ..... 297/344.19
(Continued)

*Primary Examiner* — Anita M King
*Assistant Examiner* — Nkeisha J Smith
(74) *Attorney, Agent, or Firm* — Lerner, David, Littenberg, Krumholz & Mentlik, LLP

(57) ABSTRACT

Generally large objects including ergonomic gaming stools are provided with a supporting assembly including an easy rolling support base to enable them to be moved easily along a generally unidirectional line of movement. An easy rolling support base for the supporting assembly includes a shaped disc member to the underside of which are affixed a plurality of freely mounted roller members in predetermined angular spaced relationship. The freely mounted roller members are so mounted that the rollers are in alignment with each other and rotate in the same direction. A roller members connecting plate is provided to facilitate mounting the roller members in predetermined angular position before they are mounted into assembled position on the easy rolling support base and to facilitate repair of a roller member that may fail. The roller members are formed of materials to support the load and shaped to oppose other than unidirectional movement.

2 Claims, 7 Drawing Sheets

U.S. PATENT DOCUMENTS

| | | | | | |
|---|---|---|---|---|---|
| 5,522,641 | A | | 6/1996 | Infanti | |
| 5,678,886 | A | | 10/1997 | Infanti | |
| 5,762,617 | A | | 6/1998 | Infanti | |
| 5,791,731 | A | | 8/1998 | Infanti | |
| 5,826,941 | A | * | 10/1998 | Olsen | 297/423.39 |
| 5,887,948 | A | * | 3/1999 | Hannes | 297/411.35 |
| 5,988,754 | A | * | 11/1999 | Lamart et al. | 297/423.38 |
| H001874 | H | * | 10/2000 | DeSantis | 297/452.58 |
| 6,149,239 | A | * | 11/2000 | Markussen et al. | 297/423.4 |
| 6,325,456 | B1 | | 12/2001 | Carnahan | |
| 6,592,134 | B2 | * | 7/2003 | Abraham | 280/79.7 |
| 6,594,951 | B1 | * | 7/2003 | Reynolds | 47/39 |
| 6,926,238 | B1 | * | 8/2005 | Blessing | 248/129 |
| 2003/0164633 | A1 | * | 9/2003 | Jakus et al. | 297/271.5 |
| 2005/0088029 | A1 | * | 4/2005 | Stokes | 297/461 |
| 2006/0102816 | A1 | * | 5/2006 | Zhang | 248/188.2 |
| 2007/0063563 | A1 | * | 3/2007 | Maze et al. | 297/317 |

* cited by examiner

OBJECTS INCLUDING GAMING STOOLS WITH AN EASY ROLLING SUPPORT BASE

CROSS-REFERENCE TO RELATED APPLICATIONS

This invention claims the benefit of the filing date of U.S. Provisional Patent Application No. 60/620,061 filed Oct. 19, 2004, the disclosure of which is hereby incorporated herein by reference.

BACKGROUND OF THE INVENTION

This invention relates generally to means for moving objects and, more particularly, to easy rolling support bases for generally larger objects such as the popular ergonomic type gaming stools now in use with associated gaming machines in gaming casinos.

In recreation and other facilities and activities such as fishing boats and casinos, the movement of objects and chairs and providing means to make them more comfortable and easier to move, operate or use has received much attention. Where the chairs are in relatively fixed positions, this has been done as shown in U.S. Pat. No. 6,325,456 by providing means for adjusting the seat on the chair; or as in U.S. Pat. No. 5,346,415 by placing the seat of the chair on a resilient member adapted to yield to the weight and movement of the user and by allowing the base on which the chair is mounted to rotate when the user is sport fishing.

In casinos it has become popular to use chairs with the gaming machines to make it more comfortable for patrons so they will spend more time gambling at the gaming machines. For example, in U.S. Pat. No. 5,522,641 an Adjustable Gaming Stool Assembly is disclosed in which the gaming stool is mounted on a column with a gas or a resilient member to enable the gaming stool to yield to the weight and movement of the user, and the seat has a mechanical or electromechanical sliding assembly to enable the gaming stool to be moved by the user, towards and away from the gaming machine.

It is also well known to those skilled in the art that roller members of all types and variations are used under small and large objects, including chairs and other furnishings, to facilitate the moving and/or rolling of these objects from place to place. As a general rule, such roller members are usually disposed on a suitable universal joint mounting for connecting the roller member to the object to enable the objects to be moved in any desired direction.

The present invention takes advantage of the capacity of such roller members to permit objects to be moved to and fro and from place to place by forming, utilizing, adapting and arranging the roller members and their associated rollers on the support base of a freely movable object or gaming stool, more particularly, large, comfortable ergonomic gaming stools and the like, so the direction of movement of each such object can be so controlled that they will move easily in generally a single line of direction.

SUMMARY AND OBJECTS OF THE INVENTION

Accordingly, it is one aspect of the present invention to provide a support assembly connected to a freely movable object for moving the object to and fro along a generally single line of direction including a relatively strong easy rolling support base having an upper surface and a lower surface, and a plurality of spaced roller members having shaped, sized and adequately strong rollers, so mounted on the lower or undersurface of the support base that the rollers of the respective roller members bear a proportionate amount of the loading on the freely movable object and are in alignment with each other and, when the object is moved, rotate to enable the object to move in the desired line of single directional movement.

It is another aspect of the present invention to provide a support assembly connected to a freely movable object for moving the object to and fro along a generally single line of direction which includes a relatively strong support base having an upper surface and a lower surface, and a plurality of spaced roller members having respectively shaped, sized and adequately strong rollers connected in a predetermined angular spaced relation to the lower surface of the support base and having the rollers so spaced and formed that the respective roller members support a proportionate share of the loading on the freely movable object, and are mounted and aligned with each other so that the rollers of each of the roller members rotate in the same direction and thus provide generally the single line of directional movement for the freely movable object.

It is still another aspect of the present invention to provide freely movable gaming stools and chairs with a disc shaped supporting base having angularly spaced and aligned roller members mounted on the underside thereof to provide easy rolling movement of the gaming stools and chairs, to and fro, generally in a single line of directional movement.

It is a further aspect of the present invention to provide a roller members connecting plate to provide means for affixing the roller members in their angularly spaced relationship for operative relation to each other and to facilitate and simplify mounting of the roller members into assembled position onto the shaped supporting member of the easy rolling support base for obtaining the desired generally single directional movement.

It is a still further aspect of the present invention to provide rollers for the roller members which are made of a relatively strong material to enable the associated roller member to support the pro rata weight of the load on the object to which the easy rolling support base is attached and to provide a shaped exterior surface of the respective rollers for the roller members that will resist efforts to change the generally single directional movement of the object to which the easy rolling support base is attached.

Thus, the present invention covers a support assembly for freely movable objects including gaming stools comprising a relatively strong and disc shaped supporting member connected to and providing a supporting base for said freely movable objects, said supporting member having a lower face, a plurality of roller members respectively having shaped and sized rollers, said roller members connected to said lower face of the disc member in predetermined angular spaced relationship to each other, and the respective rollers on each of the roller members shaped and sized to enable their respective roller members to support a proportional share of the loading on the objects being moved and the respective rollers disposed in alignment with each other and to rotate in the same direction to provide generally single directional movement of said objects.

Further, the support assembly for freely movable objects as above described in which the plurality of roller members are disposed in generally uniform angular spaced relation to each other as a function of the weight or loading on the objects.

The present invention further covers a roller members connecting plate to provide means for simplifying the assembly and for connecting the roller members in their predetermined angular relationship so as to facilitate connecting the roller members into assembled position on the easy rolling support base and for simplifying repair of any roller that fails on a roller member during use of the present invention.

The present invention further covers roller members for an easy rolling support assembly for freely movable objects each having a respective roller wherein the respective rollers on the roller members are sized, shaped and formed from materials having sufficient strength to enable the associated roller members to support a proportionate share of the weight or loading on the freely movable objects to be moved, and the shape of the rollers resists effort to move the object other than in a desired general single directional line of movement.

The present invention also covers roller members for an easy rolling support assembly for freely movable objects, each having a respective shaped and sized roller wherein the roller has a larger center section and tapers from the center section to the opposite side edges of the respective roller so that the roller resists sidewise movement during use and operation of the easy rolling support assembly.

The present invention still further covers a roller for a roller member in which the transverse centerline of the roller is the apex of the outer surface, and the remainder of the outer surface tapers from the centerline apex to the respective opposite sides of the roller at an approximate range from 3° to 8°.

DETAILED DESCRIPTION

The present invention will be described and shown with respect to gaming chairs or gaming stools for gaming machines in casinos for which it is particularly adapted for use. However, those skilled in the art will recognize that this is only by way of illustration and not intended to so limit the invention. Thus, the present invention can be used for the moving of all sorts, shapes and sizes of objects where the preferred movement is along a single line of directional movement for any given application or purpose.

Figure 1:
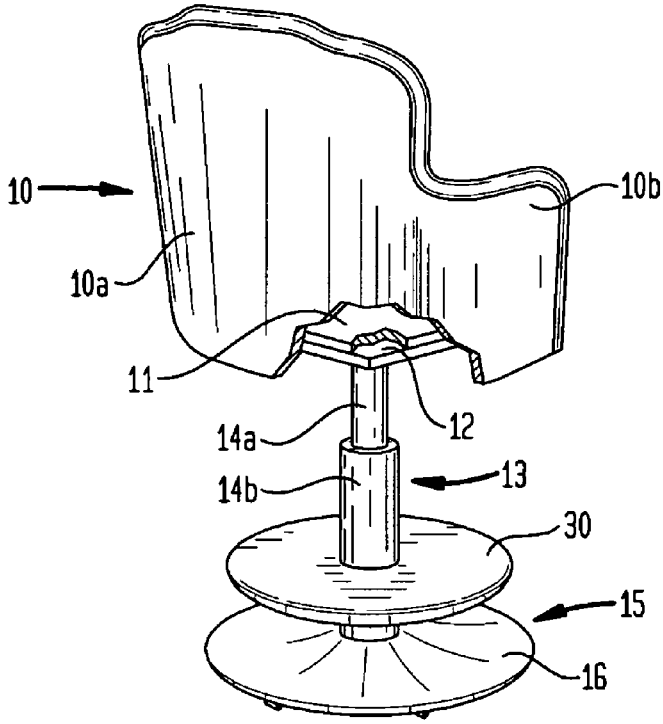
FIG. 1 is a rear perspective view partly in vertical section of a gaming stool having one form of easy rolling support base in accordance with the present invention.

Thus, referring to the drawings, FIG. 1 shows one type of freely movable casino gaming stool generally designated 10 which is adapted for use with an associated gaming machine, not shown. The gaming stool illustrated is one type of ergonomic seating to which the present invention is particularly applicable because it enables the user to easily move such comfortable seating and adapts the gaming stool for movement in and along a single directional line of movement.

Ergonomic type gaming stools are relatively large and comfortable chair members having a back 10*a* and spaced side arms as at 10*b* above and about a seating section 11, so that when the patron sits in the seating section 11, they can relax against the back 10*a* and the spaced side arms 10*b* of the gaming stool 10. Since ergonomic chairs are known and available in the commercial marketplace, the gaming stool 10 will not be described in more detail.

The underside of the seating section 11 of the gaming stool 10 is connected to a base plate 12 by any suitable means such as threaded bolts, not shown, as is well known in the art. Base plate 12 enables the gaming stool 10 to be mounted on and supported by a supporting assembly generally designated 13. Supporting assembly 13 may be a solid post or preferably, as shown, a telescopically and slidably associated upper support member 14*a* and lower support member 14*b*. A gas cylinder as at 14*c* in the lower support member 14*b* holds the upper and lower support members in spaced relation, and when a user sits in the seating section of the gaming stool 10, the upper member yields against the pressure of the gas in the gas cylinder 14*c* as a function of the weight of the person using the gaming stool. Base plate 12 is connected to the upper end of upper support member 14*a* of the telescopically connected and operatively related lower supporting member 14*b* of the support assembly 13. One form of the easy rolling support base assembly 15, in accordance with the present invention, is disposed at and connected to the lower or remote end of the lower support member 14*b*, all of which is shown in FIGS. 1 and 2 of the drawings.

Figure 2:
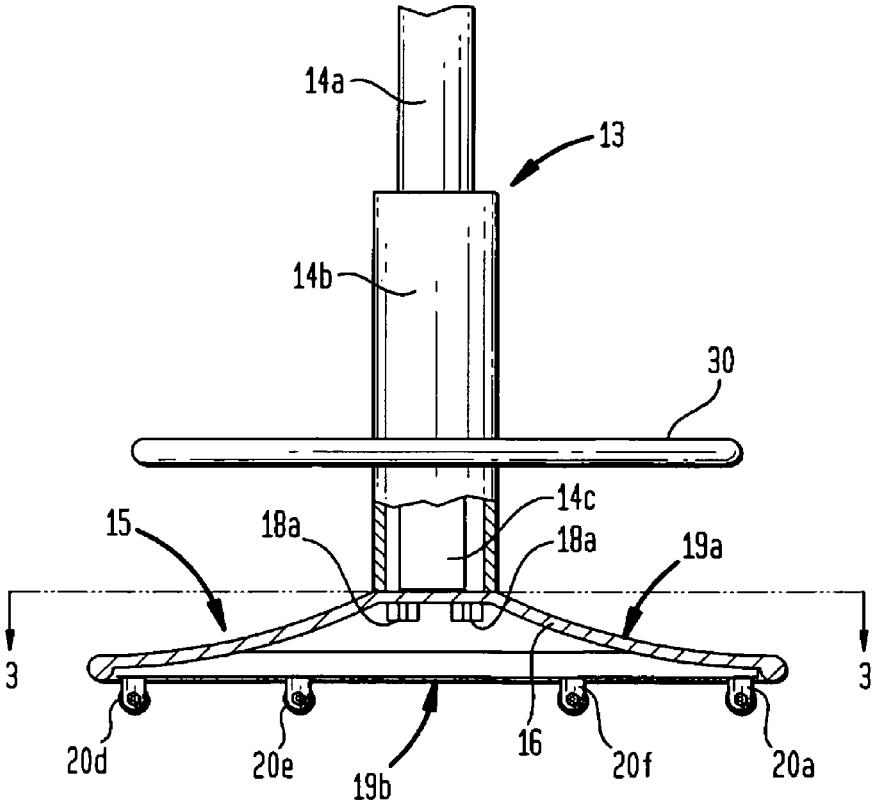
FIG. 2 is a side view partly in vertical section of a portion of the support assembly and the form of easy rolling support base shown in FIG. 1.

The form of the easy rolling support base assembly 15 as shown in FIGS. 1 and 2 includes an annular disc member 16. Since disc member 16 will bear the entire weight of the gaming stool 10, it must have suitably strong structure. Thus, disc member 16 is generally in the form of a heavy metal plate made of steel or other strong alloy and will have a thickness in a range from ½" to 1½". Although the disc member is shown in the form of a unitary plate, it is also possible to fabricate the disc member 16 from thinner gauge materials which can be formed or fabricated into a strong box-like support assembly, not shown, when, for example, it is desired to enhance the artistic appearance of the supporting assembly 13 and/or the gaming stool 10. Further, while the disc member 16 is shown as circular, those skilled in the art will recognize that the disc member 16 can have any geometric shape, such as a square, hexagon, etc., without departing from the scope of the present invention.

Figure 3:
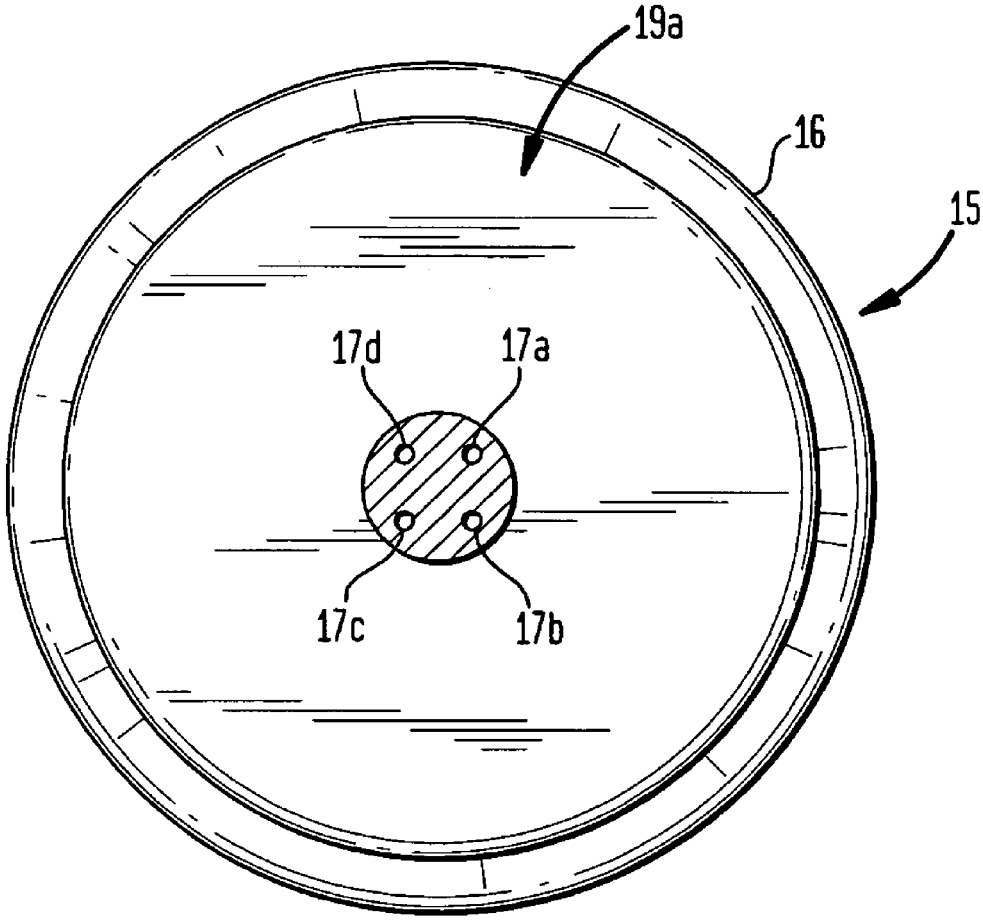
FIG. 3 is a cross section taken along line 3-3 of FIG. 2 showing an enlarged top plan view of the form of easy rolling support base shown in FIGS. 1 and 2.

Disc member 16 has spaced, generally centrally disposed openings 17*a*, 17*b*, 17*c* and 17*d* which enable the disc member to be threadably affixed as by threaded members 18*a* or welded or otherwise fixedly connected to the lower end of the supporting member 14*b*, as is shown in FIGS. 2 and 3 of the drawings.

Figure 4:
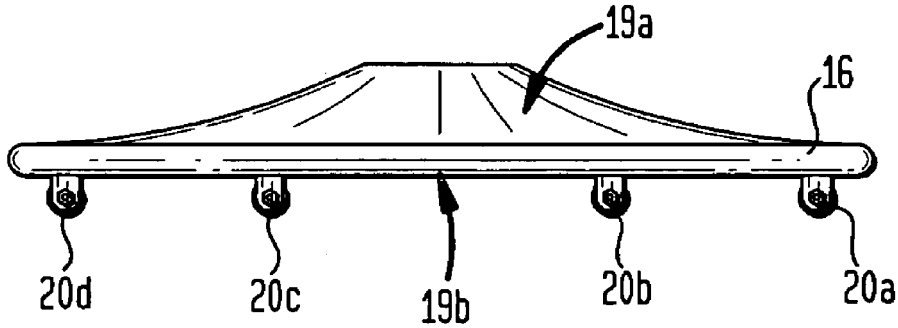
FIG. 4 is an enlarged side view of the form of easy rolling support base shown in FIGS. 1, 2 and 3.
Figure 5:
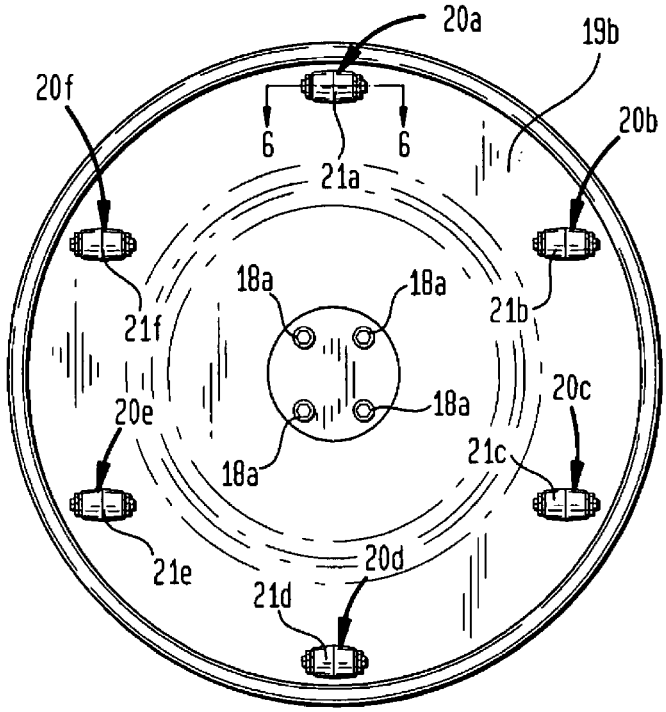
FIG. 5 is an enlarged bottom plan view of the annular disc member of the form of easy rolling support base shown in FIGS. 1, 2 and 3.

Further, annular disc member 16 of the easy rolling support assembly 15 has an upper face 19*a* and a lower face or underside 19*b*. On the underside or lower face 19*b* of the annular disc member 16, a plurality of roller members as at 20*a*, 20*b*, 20*c*, 20*d*, 20*e* and 20*f* are respectively connected in generally uniform and equal angularly spaced relation of sixty degrees (60°) to each other, all of which is shown in FIGS. 2, 4 and 5 of the drawings. This spacing is illustrated for six (6) rollers. Thus, if the number of rollers is increased to eight (8), this spacing will change to forty-five degrees (45°). The number of rollers to be used will be a function of the size, shape and weight of the object to which the supporting assembly 13 of the easy rolling disc base assembly is affixed.

Roller members 20*a*, 20*b*, 20*c*, 20*d*, 20*e* and 20*f* are preferably, but not necessarily, identical in structure to facilitate fastening of these rollers into assembled position during manufacture and to reduce the cost of manufacture.

In the illustrated form of the present invention, each of the roller members 20*a*, 20*b*, 20*c*, 20*d*, 20*e* and 20*f* are identical to each other, have rollers as at 21*a*, 21*b*, 21*c*, 21*d*, 21*e* and 21*f* and are affixed to the lower face 19*b* of the disc member 16 in alignment with each other and in circumferential spaced angular positioning so that the rollers rotate in the same direction to provide for and facilitate the improved unidirectional movement of the relatively larger gaming chairs when in use in the gaming casino or for objects to which the supporting assembly may be affixed for other applications and uses.

Figure 6:
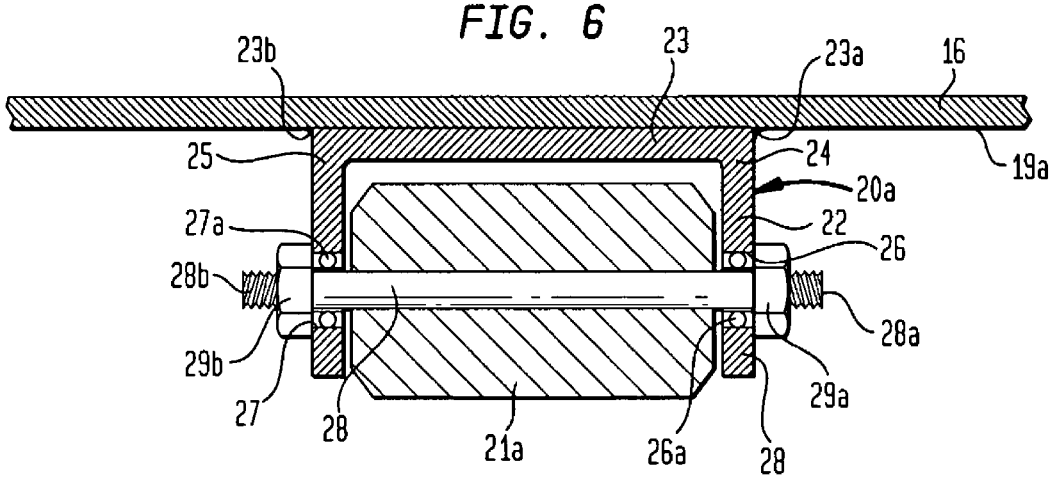
FIG. 6 is a cross-section of one of the roller brackets and the roller taken on line 6-6 of FIG. 5.

Reference is further made to FIG. 6 which shows in enlarged form of one of the roller members 20*a*. Only one of the roller members needs to be illustrated because all the roller members in this illustrated form of the present invention are identical to each other. Thus, the illustrated roller 20*a* has a u-shaped bracket 22 having an elongated horizontal section 23 with spaced vertical arms at either end as at 24 and 25. The horizontal section 23 of the u-shaped bracket provides means for fastening the roller member 20*a* into assembled position by any suitable means such as spot welding as at 23*a* and 23*b*. The vertical arms have openings inwardly of their respective outer ends as at 26 and 27 in which ball-bearing assemblies 26*a* and 27*a* are fixedly connected for rotatably mounting roller shaft 28. Shaft 28 is held in assembled position by threaded sections 28*a* and 28*b* at the respective ends of the roller shaft 28 and the associated threaded nuts 29*a* and 29*b* to provide for free rotational movement in either direction. Mounted on each roller shaft 28 is one of the rollers as at 21*a*, 21*b*, 21*c*, 21*d*, 21*e* and 21*f* for each of the respective roller member 20*a*, 20*b*, 20*c*, 20*d*, 20*e* and 20*f*. The roller 21*a* for roller member 20*a*, as is the case for all the respective roller members, is mounted about the roller shaft 28 and therefore rotates freely as may be required in assembled position on the disc member 16. Roller members with rollers rotatably mounted in bearings of the type shown and above described are easily purchasable on the open market and therefore will not be more fully described because their general structure and operation is known to those skilled in the art.

As will be clear from the drawings, the roller members 20*a*, 20*b*, 20*c*, 20*d*, 20*e* and 20*f* not only have freely rotatable rollers but also each of the rollers is oriented and aligned in the same direction generally parallel to each other. Thus, with this strong support assembly 13, when the user is seated on the gaming stool, it can be easily moved to and fro along a unidirectional line of movement towards and away from an associated gaming machine, not shown.

A footrest member 30 can be connected medially along the support assembly 13 for the further comfort of the casino patron.

Thus, the operative interrelation of the elements of the supporting assembly for enabling and adapting an ergonomic casino stool for easy rolling unidirectional movement towards and away from an associated gaming machine has been shown and described with respect to the important and desirable movement for the use of these chairs in this particular type of application and other types of applications, purposes, objects and uses.

Referring to the further drawings, FIGS. 7 to 17 show another ergonomic type gaming stool 110 having a back 110*a* and spaced side arms as at 110*b* above and about a seating section 111, so that when the casino patron sits in the seating section 111, they can relax against the back 110*a* and the spaced side arms 110*b* of the gaming stool 110.

Figure 7:
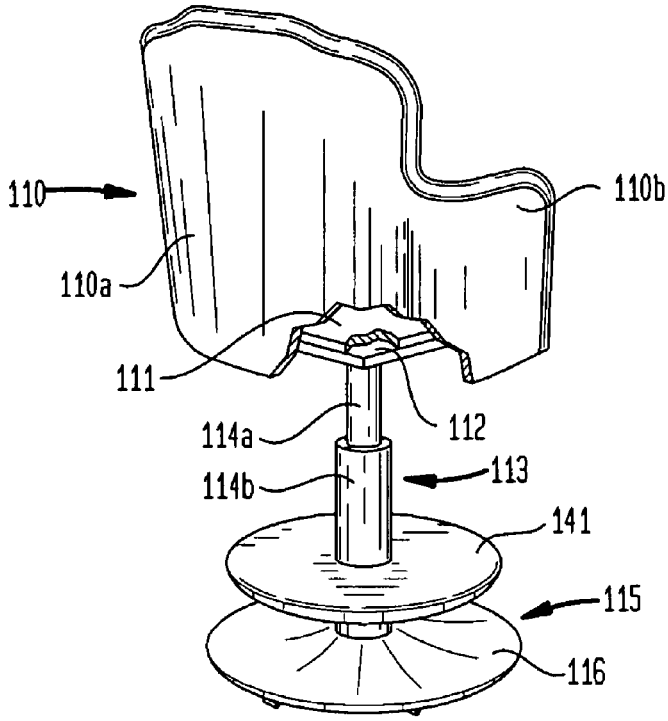
FIG. 7 is a rear perspective view partly in vertical section of a gaming stool having another form of the easy rolling support base in accordance with the present invention.
Figure 8:
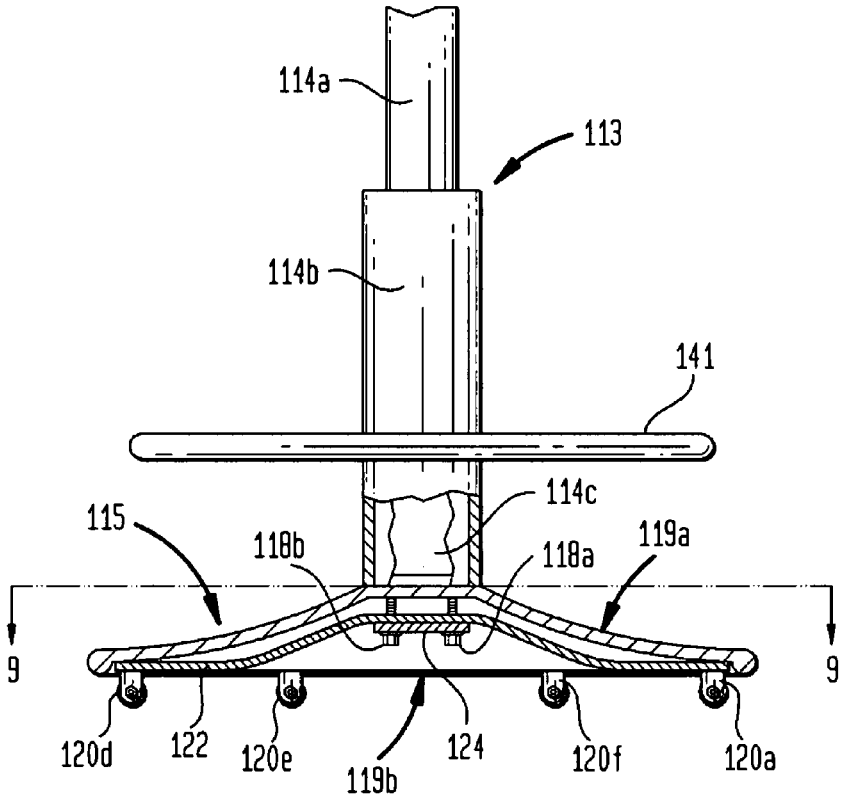
FIG. 8 is a side view partly in vertical section of a portion of the support assembly and the form of easy rolling support base shown in FIG. 7.
Figure 9:
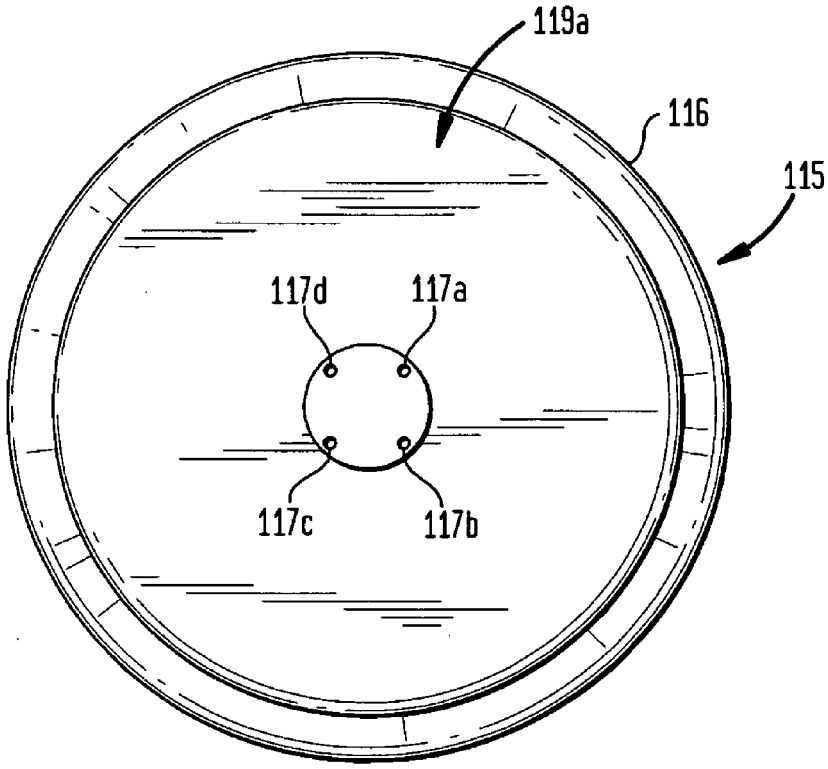
FIG. 9 is a cross section taken on line 9-9 of FIG. 8 showing a top plan view of the form of easy rolling support base shown in FIGS. 7 and 8.
Figure 10:
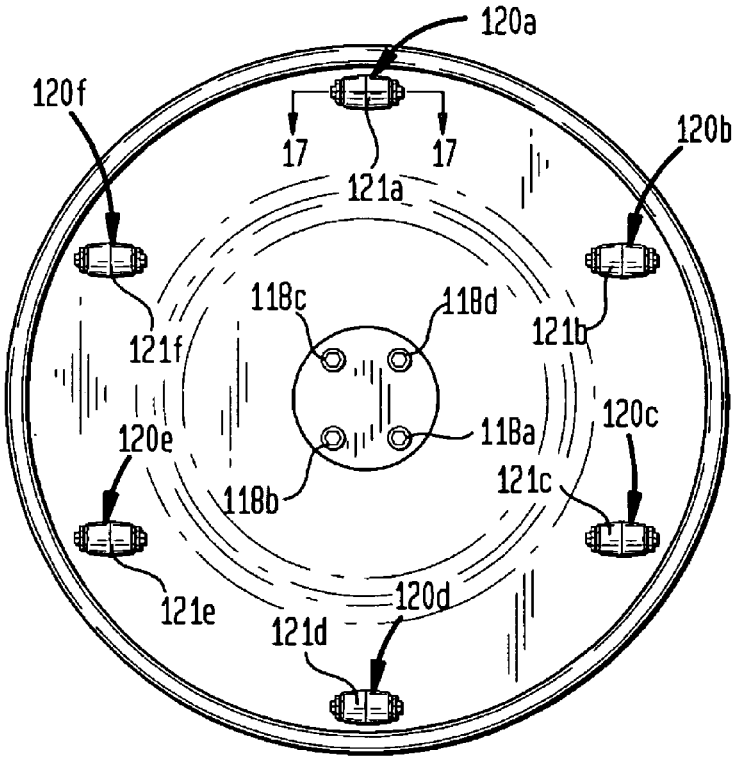
FIG. 10 is a bottom plan view of the form of easy rolling support base shown in FIGS. 7 and 8 and the means for connecting it to the support assembly.
Figure 11:
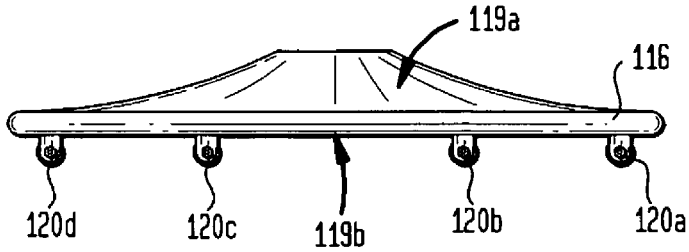
FIG. 11 is a side view of the form of easy rolling support base shown in FIGS. 7, 8, 9 and 10.

The underside of the seating section 111 of the gaming stool 110 is connected to a base plate 112 by any suitable means not shown, as is well known in the art. Base plate 112 enables the gaming stool 110 to be mounted on and supported by a supporting assembly generally designated 113. Supporting assembly 113 may be a solid post or preferably, as shown, a telescopically and slidably mounted upper support member 114*a* in an operatively associated lower support member 114*b*. Base plate 112 is connected to the upper end of slidably mounted upper support member 114*a* of the support assembly 113. A gas cylinder as at 114*c* in the lower support member 114*b* normally maintains the upper support member 114*a* and lower support member 114*b* in predetermined spaced relation. When a user sits in the seating section of the gaming stool 110, the upper member yields against the pressure of the gas in the gas cylinder 114*c* as a function of the weight of the person using the gaming stool. The easy rolling support base 115, in accordance with the present invention, is disposed at and connected to the lower or remote end of the lower support member 114*b*, all of which is shown in FIGS. 6 and 7 of the drawings.

The easy rolling support base 115 includes an annular disc shaped member 116. Since disc shaped member 116 will bear the entire weight of the gaming stool 110, it must have suitably strong structure. Thus, disc shaped member 116 is generally in the form of a heavy metal plate stock made of steel or other strong alloy and will have a thickness in a range from ½" to 1½". Although the disc shaped member is shown in the form of a unitary plate, it is also possible to fabricate the disc member 116 from thinner gauge materials which can be formed or fabricated into a strong box-like support assembly, not shown, when, for example, it is desired to enhance the artistic appearance of the supporting assembly 113, the easy rolling support base 115 and/or the gaming stool 110. Further, while the disc shaped member 116 is shown as circular, those skilled in the art will recognize that the disc shaped member 116 can have any geometric shape, such as a square, hexagon, etc., without departing from the scope of the present invention.

Disc shaped member 116 has spaced, generally centrally disposed openings 117*a*, 117*b*, 117*c* and 117*d* which enable the disc member to be threadably affixed as by threaded member 118*a*, 118*b*, 118*c* and 118*d*, which will also serve to affix and mount a roller members support and connecting plate 122, on which the spaced roller members are assembled, to the underside of the disc shaped member 116, all of which is shown in FIGS. 7, 8, 10, 11 and 12 of the drawings and hereinafter more fully described.

Thus, annular disc shaped member 116 of the easy rolling support assembly 115 has an upper face 119*a* and a lower face or underside 119*b*. On the underside or lower face 119*b* of the annular disc shaped member 116, a plurality of roller members as at 120*a*, 120*b*, 120*c*, 120*d*, 120*e* and 120*f* are respectively assembled, affixed and disposed in generally uniform and equal angularly spaced relation of sixty degrees (60°) to each other, all of which is shown in FIGS. 7, 8, 10 and 11 of the drawings. This spacing is illustrated for six (6) roller members. Thus, if the number of roller members is increased to eight (8), this spacing will change to forty-five degrees (45°). The number of roller members to be used and the annular spacing will be a function of at least three factors. First, is the size, shape and weight of the objects and the loading or anticipated loading on the objects to be moved, to which the supporting assembly 113 with the disc shaped member 116 of the easy rolling support base 115 is affixed. Second, is the independent structure for supporting and assembling the respective roller members, as is hereinafter also more fully described. Third, is the structure of the respective roller members which each have to support a proportional amount of the total weight of the object to be moved and the loading or anticipated loading on the object. Further, while the annular spacing and the position of the roller members are shown as uniform, it will be clear that the annular spacing can be other than uniform in order to distribute the weight of the objects and the loading on the objects proportionately to each of the roller members, as will be understood by those skilled in the art.

The roller members 120*a*, 120*b*, 120*c*, 120*d*, 120*e* and 120*f* are preferably, but not necessarily, identical in structure to facilitate fastening of these rollers into assembled position during manufacture and to reduce the cost of manufacture. Thus, any type of roller members may be used that will meet the factors required to properly support the gaming stool 110 to achieve the desired unidirectional movement in accordance with the present invention, during use of the gaming stool in the casino.

In the illustrated embodiment of the present invention, each of the roller members 120*a*, 120*b*, 120*c*, 120*d*, 120*e* and 120*f* are identical to each other, have rollers as at 121*a*, 121*b*, 121*c*, 121*d*, 121*e* and 121*f* and are assembled and affixed to the roller support and connecting plate 122 at the underside or lower face 119*b* of the disc member 116 in alignment with each other and in circumferential spaced angular positioning so that the rollers rotate in the same direction to provide for and facilitate the improved unidirectional movement of the relatively larger gaming chairs when in use in the gaming casino or for objects to which the supporting assembly may be affixed for other applications and uses.

In order to affix the roller members 120*a*, 120*b*, 120*c*, 120*d*, 120*e* and 120*f* into assembled position at the lower surface or underside of the disc shaped member 116 of the easy rolling support base 115, a roller members support and connecting plate 122 is provided which facilitates, simplifies and enables the selected quantity of roller members to be properly oriented and connected on the roller members support and connecting plate 122 in the desired spaced relation and alignment to obtain proper weight distribution and for the desired unidirectional movement of the gaming stool before the roller members support and connecting plate 122 is affixed into assembled position at the underside or lower face 119*b* of disc shaped member 116.

Roller members support and connecting plate 122 is an annular plate preferably made of thick sheet metal material which may be provided with a coating to protect and preserve the connecting plate 122 and its appearance. Roller members support and connecting plate 122 has centrally disposed spaced and curved shaped openings as at 123*a*, 123*b*, 123*c* and 123*d* which are disposed to align with the openings 117*a*, 117*b*, 117*c* and 117*d* in the disc shaped member 118 for mounting the roller members support and connecting plate 122 into assembled position at the lower surface or underside of the disc shaped member 116. The curved shaped openings 123*a*, 123*b*, 123*c* and 123*d* are sized and shaped so the roller members support and connecting plate 122 can be shifted and rotated to exactly align the roller members 120*a*, 120*b*, 120*c*, 120*d*, 120*e* and 120*f* in assembled position to provide the desired unidirectional movement for the easy rolling support base 115.

A cover and locking member 124 has four (4) spaced openings as at 125*a* and 125*b* so spaced that the threaded members 118*a*, 118*b*, 118*c* and 118*d* serve to connect the cover and locking member 124 and all the elements of the easy rolling support base 116 into assembled position by engagement with the centrally disposed openings 117*a*, 117*b*, 117*c* and 117*d* in the lower end of the lower support member 114*b* of the support assembly 113. This brings the cover and locking member 124 and the roller members support and connecting plate 122 into assembled position at the lower surface or underside 119*b* of the disc shaped member 116, all of which is shown by FIGS. 7, 8, 9, 10 and 11 of the drawings.

Figure 12:
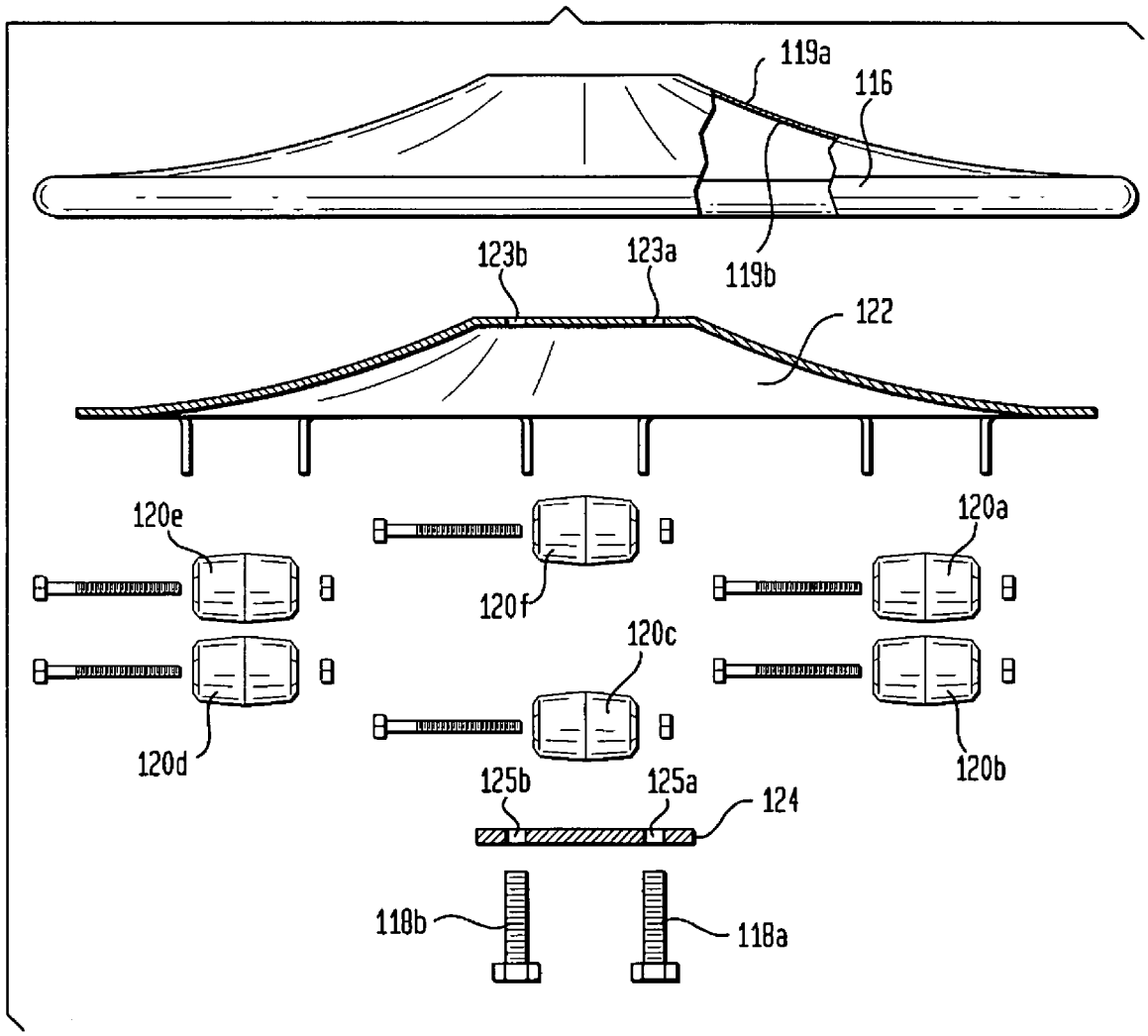
FIG. 12 is an exploded view partly in vertical section of the form of easy rolling support base shown in FIGS. 7, 8, 9, 10 and 11.
Figure 13:
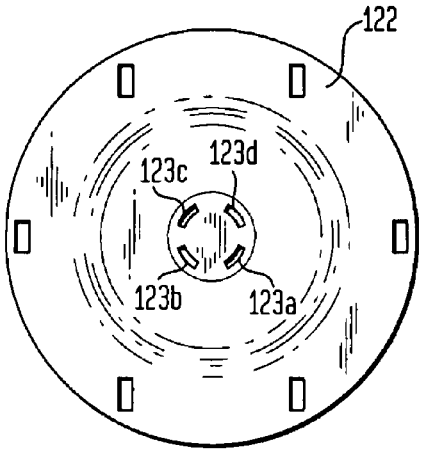
FIG. 13 is a top plan view of the roller members connecting plate shown in FIG. 12.
Figure 14:
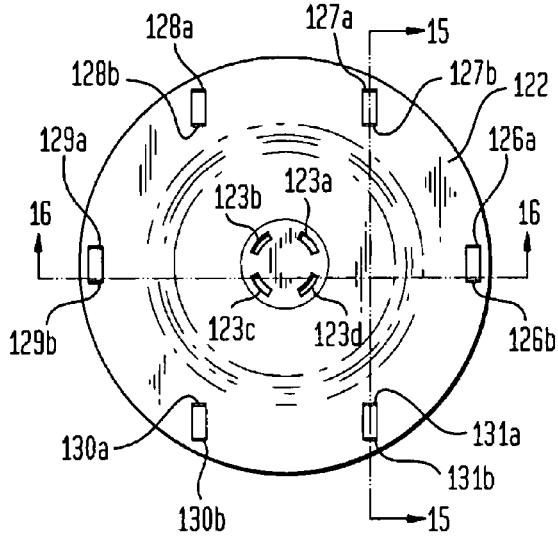
FIG. 14 is a bottom plan view of the roller members connecting plate shown in FIG. 12.
Figure 15:
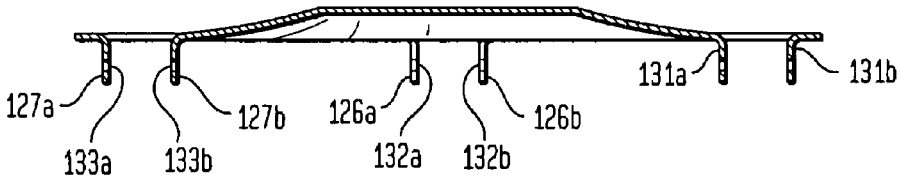
FIG. 15 is a cross section taken on line 15-15 of FIG. 14.
Figure 16:
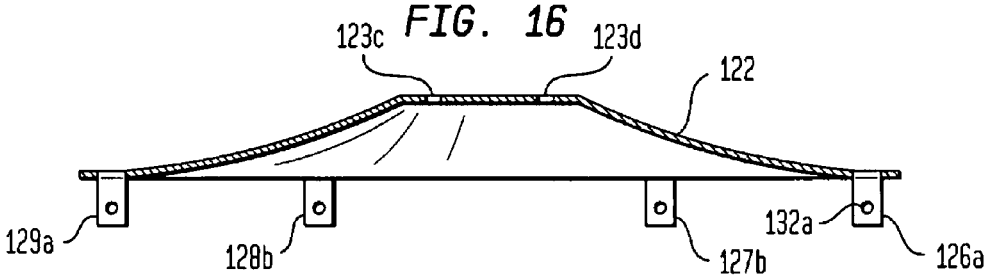
FIG. 16 is a cross section taken on line 16-16 of FIG. 14.

As further shown in FIGS. 12, 13 and 14, roller members support and connecting plate 122 provides a simple means for assembling and positioning the required or desired number of roller members before it is assembled at the underside of the disc shaped member 116. Thus, in this illustrated form of the present invention, roller members 120*a*, 120*b*, 120*c*, 120*d*, 120*e* and 120*f* are mounted or connected into assembled position on the roller members support and connecting plate 122 by striking, cutting or otherwise forming circumferentially spaced and paired roller member brackets as at 126*a* and 126*b*, 127*a* and 127*b*, 128*a* and 128*b*, 129*a* and 129*b*, 130*a* and 130*b* and 131*a* and 131*b* at the desired angular sixty degree relations for equally spacing the roller members from each other. Each of the respective spaced and paired roller brackets are provided with mounting openings as at 132*a* for roller member bracket 126*a* and 132*b* for roller member bracket 126*b*; 133*a* for roller member bracket 127*a* and 133*b* for roller member bracket 127*b*; and the same for the respective additional roller brackets shown in the drawings. This enables each of the respective roller members 120*a* to 120*f* to be assembled on the roller members support and connecting plate 122 before the roller members support and connecting plate is affixed in operating position at the underside or lower face of the disc shaped member 116 of the easy rolling support base 115. Thus, when the roller member support and connecting plate 122 is assembled and connected into the lower surface or underside 119*a* of the disc shaped member 116, the roller members will be disposed to enable the total loading on the gaming stool 110 to be evenly distributed over the easy rolling support base 115. In addition, this roller members support and connecting plate 122 simplifies means for repairing a roller on any of the roller members mounted thereon which may fail during use of the easy rolling support base in accordance with the present invention. Repair is simplified because the roller members connecting plate can be removed or disassembled from the easy rolling support base 116 by removing the threaded members 118*a* to 118*d* inclusive and reassembled when the repair is completed by the use of these same threaded members.

In forming the paired brackets 126*a* and 126*b* to 131*a* and 131*b* inclusive on the roller members connecting plate 122, as shown in FIGS. 12, 13, 14, 15 and 16, the brackets will be so formed that the rollers 121*a*, 121*b*, 121*c*, 121*d*, 121*e* and 121*f* of the respective roller members will be in substantially exact alignment with each other, such that the rollers will lie in a plane substantially perpendicular to the single line of directional movement desired for the gaming stool 110 and so rotate when combined with the shape of the respective roller members on the roller member as hereinafter describe the desired unidirectional movement for the gaming stool.

Figure 17:
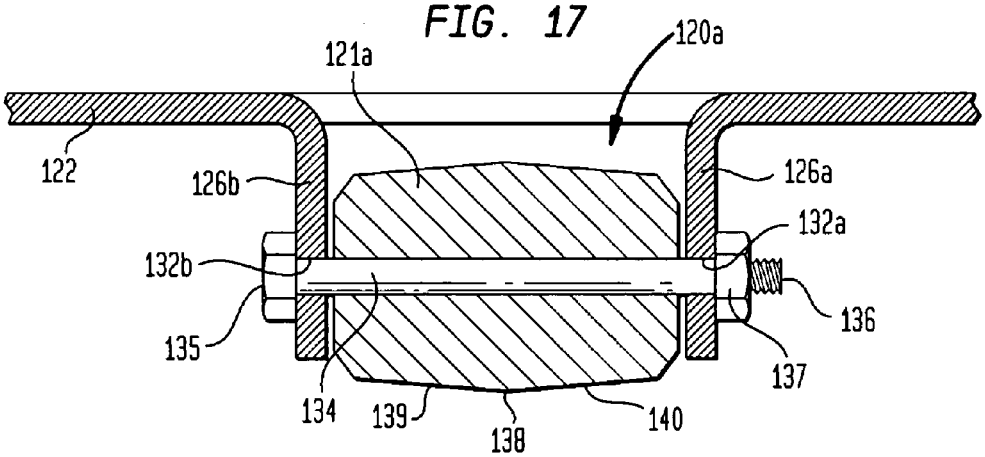
FIG. 17 is a cross-section of one of the roller members taken on line 17-17 of FIG. 10.

Reference is further made to FIG. 17 which shows in enlarged form one of the roller members 120*a*. Only one of the roller members needs to be illustrated because all the roller members in this illustrated form of the present invention are identical to each other. Thus, for the illustrated roller 120*a*, spaced and paired brackets 126*a* and 126*b* extend from the lower face of the roller members support and connecting plate 122. Spaced and paired brackets 126*a* and 126*b* have the openings inwardly of their respective outer ends as at 132*a* and 132*b* in which a roller shaft 134 is mounted. Roller shaft 134 is held in assembled position by an enlarged shaft head 135 at one end and a threaded section 136 at the opposite end on which an associated self-locking threaded nut 137 is connected. Self-locking threaded nuts are well known in the art. Mounted on the roller shaft 134 is the roller 121*a* for the illustrated roller member 120*a*. The roller 121*a* for roller member 120*a*, as is the case for all the respective roller members, is mounted about the roller shaft 131 and therefore rotates freely as may be required in assembled position on the disc shaped member 116.

Roller 121*a* has several distinct characteristics. First, it must be made of a material which can withstand the load capacities that are distributed onto the respective roller members during normal operation and use of the easy rolling support base 115. It has been found that nylon, reinforced nylon and the like plastic materials meet the criteria for this aspect of the rollers. Second, the roller 121*a* must be so shaped that the user of the gaming stool 110 will not be able to easily move the gaming stool out of the unidirectional line of movement established for the easy rolling support base 115 in accordance with the present invention. Thus, roller 121*a* as shown in FIG. 17 has a greater circumference at the center and apex 138 on the surface of the roller 121 and tapers from the center to the respective opposite outer ends or sides of the roller as at 139 and 140 up to at least five degrees (5°). It has been found that this configuration for the rollers 121*a*, 121*b*, 121*c*, 121*d*, 121*e* and 121*f* makes it difficult for the user of the gaming stool 110 to move the chair off the unidirectional line of movement established for the easy rolling support base 115. Thus, the shape of the rollers, as above described, for the roller members 120*a* to 120*f* is not the conventional roller for such roller bearing members. Further, while this specific shape has been described, those skilled in the art will recognize that other shapes may be established for accomplishing the object and purpose as above described without departing from the scope of the present invention.

Thus, from the drawings and the above description, the roller members 120*a*, 120*b*, 120*c*, 120*d*, 120*e* and 120*f* not only have freely rotatable sized and shaped rollers made of weight bearing materials but also each of the rollers is oriented and aligned in the same direction, generally parallel to each other. Thus, in a gaming stool with this strong support assembly 113 and easy rolling support base 115, when the user is seated on the gaming stool, it can be easily moved to and fro along a unidirectional line of movement towards and away from an associated gaming machine, not shown.

A footrest member 141 can be connected medially along the support assembly 113 for the further comfort of the casino patron.

The operative interrelation of the elements of the supporting assembly for enabling and adapting an ergonomic casino stool for easy rolling unidirectional movement towards and away from an associated gaming machine has been shown and described with respect to the important and desirable movement for the use of these chairs in this particular type of application. Other types of objects for a variety of applications, purposes and uses, on which the same combination of supporting elements can be used, will become apparent from the nature of the disclosure as set forth herein.

While the invention has been shown and described with reference to presently conceived preferred embodiments, those skilled in the art will recognize that various modifications and changes can be made without departing from the spirit and scope of the invention as defined by the appended claims. Therefore, the appended claims should be accorded the broadest interpretation so as to encompass all equivalent structures and devices to that as disclosed, described and claimed herein.

The invention claimed is:

1. A support assembly connected to an object for moving the object to and fro along a generally single line of direction comprising:

a. the support assembly having an upper end and a lower end, b. an easy rolling support base connected to the lower end of the support assembly including an arcuate disc shaped member with an upper surface and a lower surface, the upper surface having an arcuate shape, c. an arcuate disc shaped roller members connecting plate sized and shaped to substantially match the arcuate disc shaped member, and means for detachably connecting the roller members connecting plate into assembled position at the lower surface of the arcuate disc shaped member, d. a plurality of spaced roller members affixed and connected on said lower surface of the disc shaped roller members connecting plate, e. said disc shaped roller members connecting plate having means for mounting each of said roller members at predetermined angular positions relative to each other in fixed alignment and for facilitating the repair and replacement of any one of said roller members, and f. the means for mounting each of the respective roller members at predetermined angular positions relative each other comprising spaced and paired brackets which are rigidly and angularly affixed extending from said lower surface of the roller members connecting plate, said paired brackets limiting said roller members to generally to and fro movement along a single directional line, and means for affixing at least one of said roller members in assembled position on each of the respective spaced and paired brackets.

2. In the support assembly as in claim 1 wherein at least one roller on each of the roller members is relatively wide and tapers from a center section of the roller in opposite directions to a smaller diameter at respective sides of the roller to prevent movement away from the single directional line of movement.

* * * * *